US005769181A

United States Patent [19]

Gussow et al.

[11] Patent Number: 5,769,181

[45] Date of Patent: Jun. 23, 1998

[54] LADDER BRACKET AND STAGING UTILIZING THE SAME

[75] Inventors: Charles F. Gussow, P.O. Box 337; Chris T. Honegger, P.O. Box 316, both of Wakefield, P.Q., Canada, J0X 3G0

[73] Assignees: Charles F. Gussow; Chris T. Honegger, both of Wakefield, Canada

[21] Appl. No.: 743,215

[22] Filed: Nov. 5, 1996

[51] Int. Cl.[6] ..... E06C 7/16

[52] U.S. Cl. ..... 182/118; 182/83; 182/117; 182/119

[58] Field of Search ..... 182/27, 83, 101, 182/102, 115, 116, 117, 118, 119, 151, 222

[56] References Cited

U.S. PATENT DOCUMENTS

| | | | |
|---|---|---|---|
| 713,358 | 11/1902 | Stiles et al. | 182/118 X |
| 1,113,509 | 10/1914 | Thrall et al. | 182/119 X |
| 1,115,803 | 11/1914 | Gallagher | 182/118 X |
| 2,503,137 | 4/1950 | Sloss . | |
| 2,599,169 | 6/1952 | Finney | 182/118 X |
| 2,663,484 | 12/1953 | MacPherson . | |
| 3,026,963 | 3/1962 | Wilkie . | |
| 3,135,351 | 6/1964 | Economos et al. | 182/119 X |
| 4,598,794 | 7/1986 | Anderson | 182/119 X |
| 4,823,912 | 4/1989 | Gould et al. . | |

OTHER PUBLICATIONS 2 pages information sheets entitled "Ladder Bracket" indicated origin Les Distributions England Division de 2907488 Canada Inc. Gatenau P.Q.

*Primary Examiner*—Alvin C. Chin-Shue
*Assistant Examiner*—Richard M. Smith

[57] ABSTRACT

A ladder support bracket for staging in which a pair of ladders are supported in a vertical position spaced from a wall and having a staging element supported by the ladder rungs. The support bracket is a rigid A-frame and the ladder is tightly clamped between the apex portion of the frame and the crossbar.

11 Claims, 4 Drawing Sheets

LADDER BRACKET AND STAGING UTILIZING THE SAME

FIELD OF THE INVENTION

The present invention relates generally to staging, known more commonly as scaffolding and more particularly to a bracket for supporting a ladder in an upright position for use as a scaffolding member and to a scaffolding incorporating such bracket.

BACKGROUND OF INVENTION

Scaffolding, also sometimes referred to as staging, utilizing ladders supported in a vertical position by brackets and having a plank or the like staging element extending from the rung of one ladder to the other is well known as is also different forms of brackets for supporting the ladder in a vertical position. By way of example reference may be had to the teachings of the following U.S. Pat. Nos. 2,503,137 issued Apr. 4, 1950, inventor H. G. Sloss; 2,663,484 issued Dec. 22, 1953, inventor W. MacPherson and 3,026,963 issued Mar. 27, 1962, inventor V. J. Wilkie.

In each of patented structures the ladder is clamped to an arm of a bracket that is perpendicular to the wall. In each of '484 and '137 the bracket is L-shaped and the other arm is parallel to and fastened to the building wall and an angle brace extends from one arm to the other with such brace being located between the ladder and the building wall. In '963 the projecting arm is stabilized by a brace extending from the free outer end of the projecting arm to the building wall where it attaches by way of a bracket to the building wall.

In each of the patented structures each bracket is angle braced to resist forces primarily only in one direction parallel to the building wall. The brackets are arranged so that one bracket resists such a force in one direction while the other resists the force in the direction opposite thereto.

SUMMARY OF INVENTION

An object of the present invention is to provide a simple ladder bracket that is angle braced relative to the ladder, which is perpendicular to the wall, so as to resist forces in each of opposite directions parallel to the building wall and thus provide a stable scaffolding.

A further principle object of the present invention is to provide a simple yet relatively strong bracket with means that projects into or extends through the hollow rung of the ladder in anchoring such ladder to the bracket.

In keeping with the foregoing there is provided in accordance with the present invention a ladder bracket comprising a rigid open A-frame that has an apex, a pair of legs diverging in a direction away from said apex with each leg terminating in a free outer end and a cross-member interconnecting said legs at a position between said apex and said free outer end of said legs. There is provided means extending into the hollow rung of a ladder for detachably anchoring such ladder to said frame and clampingly holding the ladder captive between said apex portion of the frame and said cross-member. In use the outer free ends of the bracket legs are attached to a wall (or roof) of a building.

LIST OF DRAWINGS

The invention is illustrated by way of example in the accompanying drawings wherein.

DETAILED DESCRIPTION OF PREFERRED EMBODIMENTS

Figure 1:
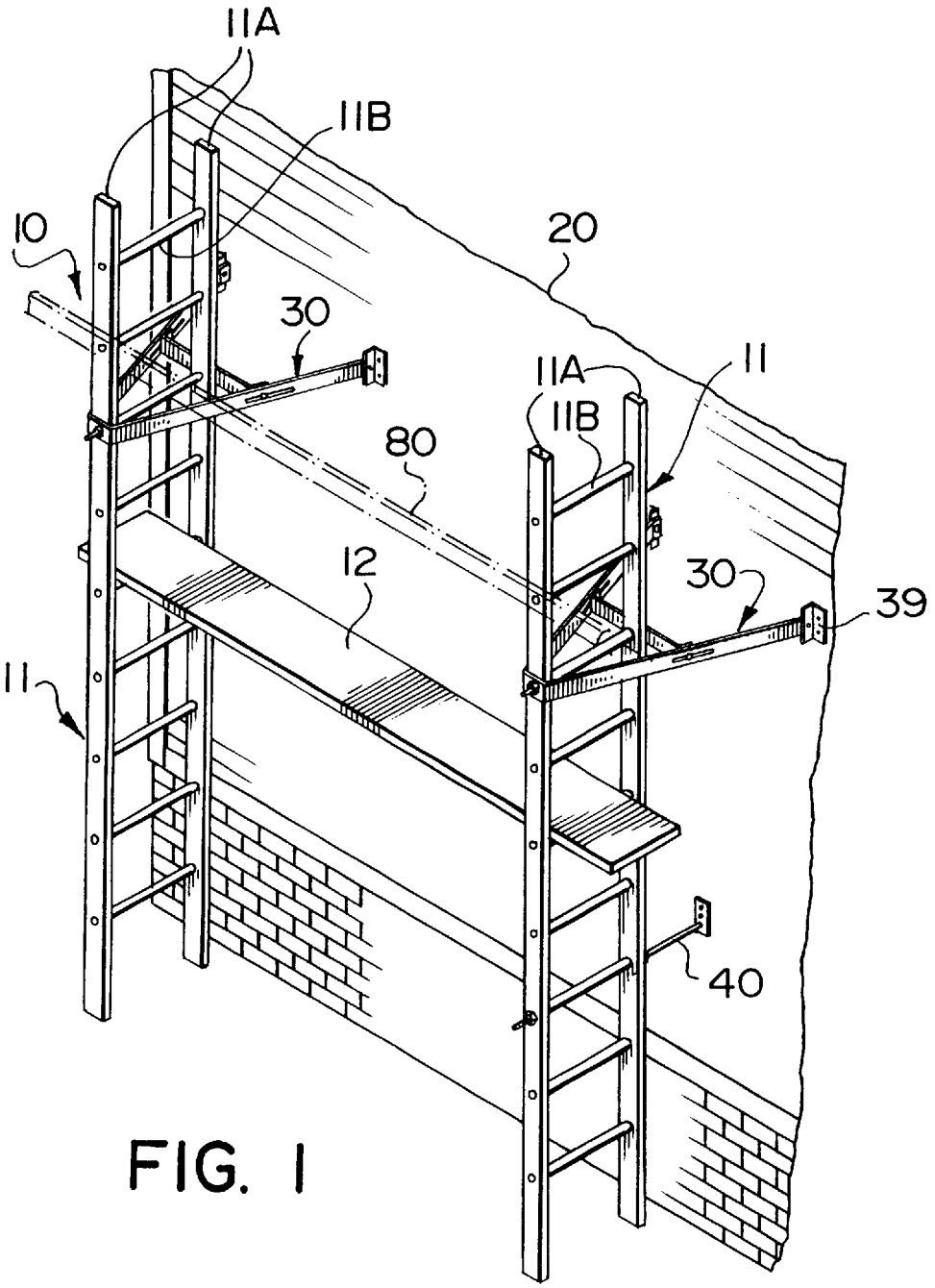
FIG. 1 is an oblique view of a scaffolding incorporating brackets provided in accordance with the present invention.

Illustrated in FIG. 1 is a scaffolding or staging structure 10 located in spaced relation with respect to a wall 20 and which includes a pair of A-frame bracket members 30 provided in accordance with the present invention and which are attached to the wall.

The staging is made simply from a pair of aluminum hollow rung ladders 11 supported vertically by respective ones of the brackets 30 and a plank, or staging member 12 extending from and resting on the rung of one ladder adjacent one end and the rung of the other ladder adjacent the other end. In case of a relatively high wall a ladder stabilizing bracket 40 may be utilized. A safety rail 80 shown in broken line in FIG. 1, may be attached by means of a safety rail bracket shown in FIG. 6 to a respective one of the ladders at a position vertically above the plank or staging member 12.

Figure 3:
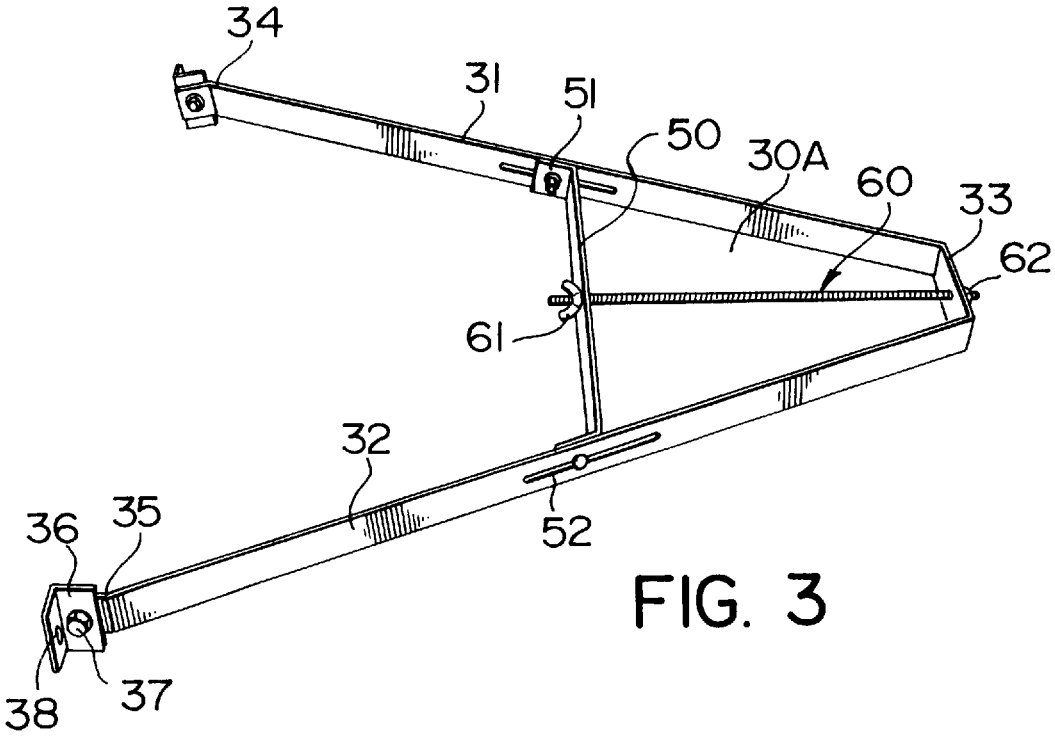
FIG. 3 is an oblique view of a single ladder bracket provided in accordance with the present invention.
Figure 5:
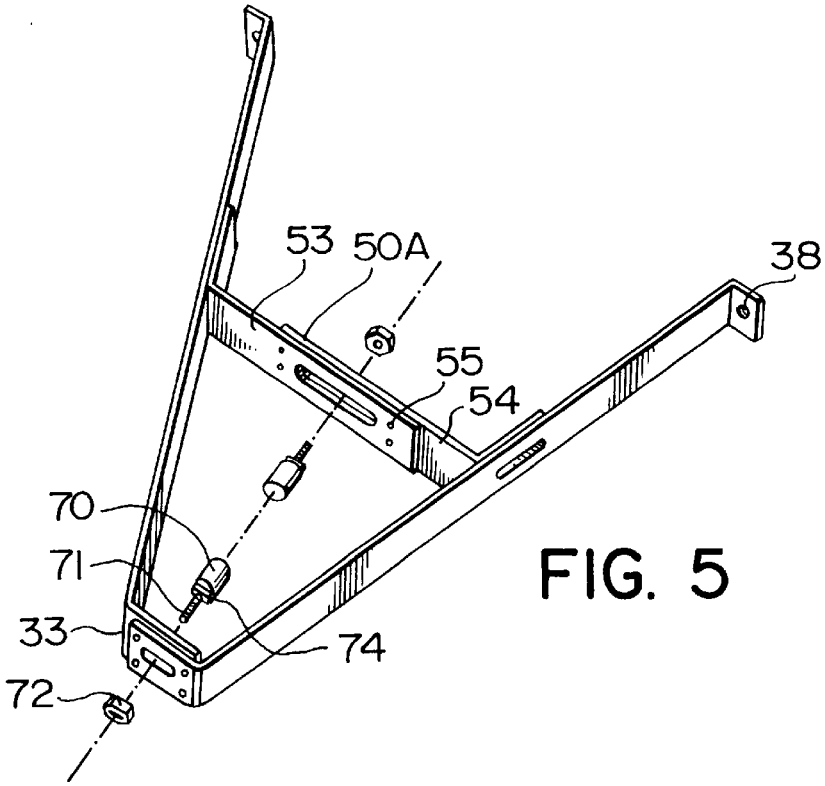
FIG. 5 is an oblique view illustrating modifications to the bracket.

The bracket 30 is simply an A-frame member comprising legs 31 and 32 diverging outwardly in a direction away from an apex 33 end of the frame wherein they merge into one another or are joined together. The legs 31 and 32 terminate in respective free outer ends 34 and 35 which may be bent outwardly as shown in FIG. 5 and apertured as at 38 for attaching to the wall by means of a screw or have angle brackets 36 attached thereto as by a bolt 37 as shown in FIG. 3. In each instance there is one or more aperture 38 for receiving a respective screw 39 to anchor the bracket to the wall (or roof).

The A-frame includes a crossbar 50 which interconnects the legs 31 and 32 at a position about mid length thereof. The crossbar is attached at opposite ends thereof to the respective legs by respective ones of a pair of bolt and nut units 51 in which the bolt passes through a slotted aperture 52 in the respective leg. The slotted aperture allows for moving the crossbar 50 toward and away from the apex 33 of the frame to accommodate therebetween ladders of different widths and clampingly retain the ladder. In the embodiment illustrated in FIG. 3 the crossbar 50 is a single member and such movement can only be accommodated by moving the free outer ends 34 and 35 of the legs toward and away from one another. In the embodiment illustrated in FIG. 5 the crossbar designated therein 50A is made from two pieces, namely pieces 53 and 54, which are detachably joined together. Components 53 and 54 are from a manufacturing point of view preferably identical to one another and they may be detachably joined together as by bolt and nut units through holes 55 and/or a bolt and nut unit to be described hereinafter with a projection that extends into an open end of the hollow rung of the ladder.

Figure 2:
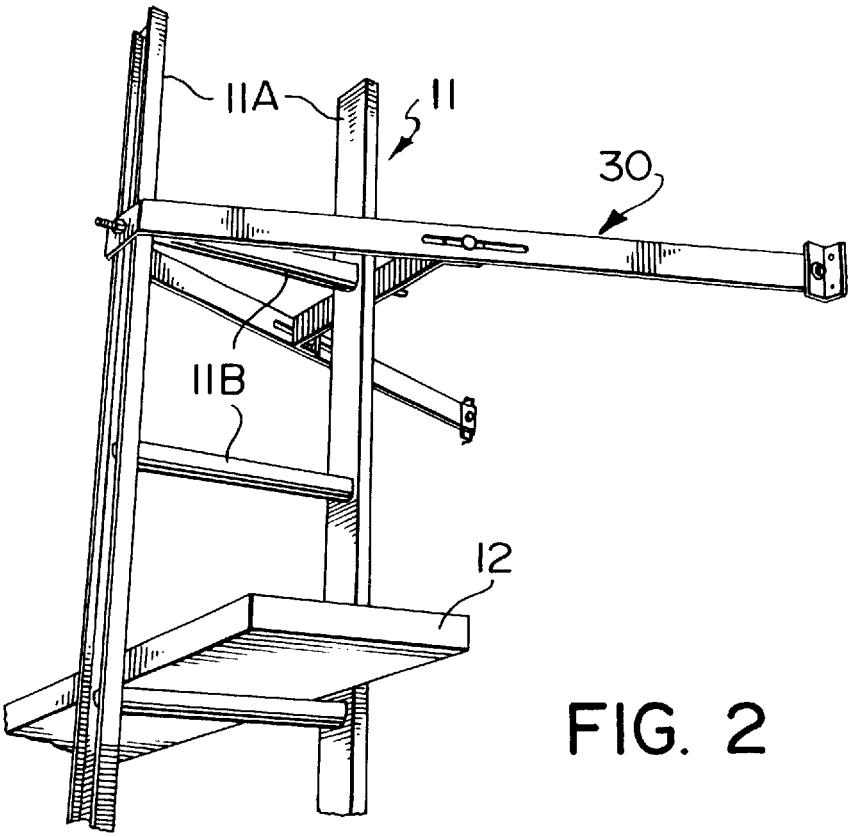
FIG. 2 is an oblique view of a right hand end portion of the scaffolding shown in FIG. 1 and on a larger scale.
Figure 4:
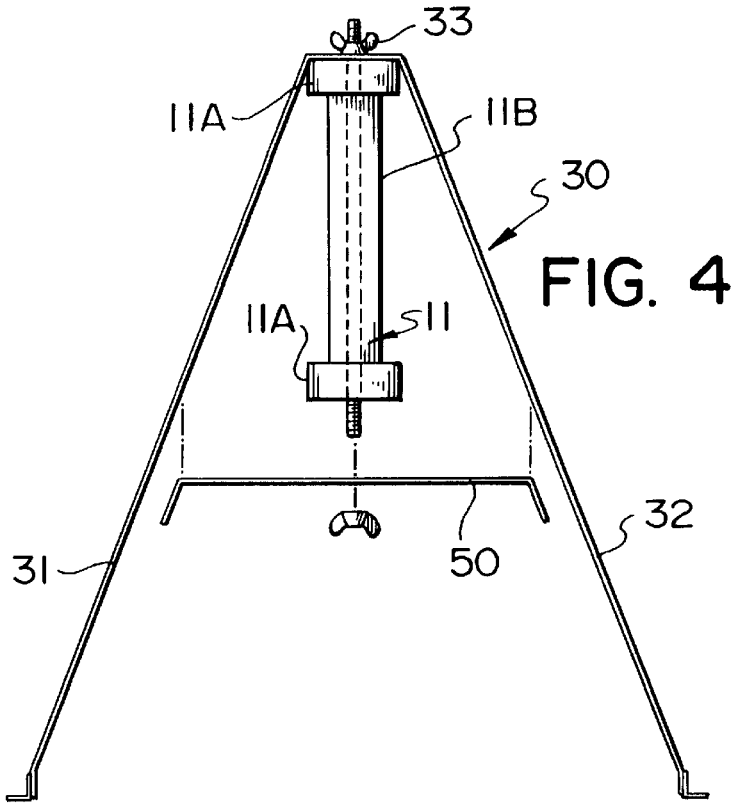
FIG. 4 is a top plan exploded view of FIG. 3 but with the ladder in place.

As seen from FIGS. 1, 2 and 4 the ladder projects through the open window 30A (see FIG. 3) of the A-frame. The ladder is held captive and clampingly engaged between the apex 33 portion of the frame and the crossbar 50. A threaded rod 60 passes through aligned apertures in the crossbar 50 (or 50A as the case may be) and in the apex 33 end portion of the frame. Wing nuts 61 and 62 on respective opposite ends of the rod are used to tightly clamp the ladder in position. One of the wing nuts obviously can be replaced if desired by an enlargement or head on the threaded rod i.e. a bolt with a head.

The apex 33 end portion of the A-frame shown in the drawings is flat along a selected length to accommodate the width of a ladder rung (see FIG. 4). This provides a cradle to receive therein, in close fitting engagement, one stile of the ladder. Should the ladder stile be wider than that illustrated in FIG. 4 shims can be readily placed on the bolt 60 and located between the ladder stile and the flat apex portion of the frame to provide a secure fastening.

In the embodiment of the A-frame illustrated in FIG. 5 the apex 33 end portion is provided by overlapping inwardly bent end portions of the respective legs and these overlapping portions can be joined together by bolt and nut units and/or a threaded bolt with an extension thereon to be described hereinafter for retaining the ladder in place. This arrangement provides for varying the length of the flat of the apex portion to fit ladder stiles that differ in width.

In the embodiment illustrated in FIG. 5 the frame is multi-component and thus collapsible for ease of packaging, shipping and/or storage.

In the embodiment illustrated in FIG. 3 the ladder is clampingly engaged between the apex 33 end portion of the frame and the crossbar 50 by the threaded bolt member 60.

In the embodiment illustrated in FIG. 5 an alternative means of restraining the ladder is provided and comprises a pair of units each having a stub shaft 70, a threaded bolt portion 71 and nut 72. The stub shaft 70 projects into the open end of a hollow rung of a ladder and the nut 72 is used to clampingly join together the members associated therewith as illustrated in FIG. 5. Also as illustrated in FIG. 5 slotted apertures are provided permitting varying the length of crossbar 50A, permitting varying the width of the apex 33 end portion of the frame and permitting locating the crossbar 50A at various different distances from the apex 33. Flats at the juncture of the shaft 70 and threaded bolt portion 71 provide a rib 74 that projects into the slot associated therewith to prevent the unit from turning when tightening and loosening the nut. In this embodiment the ladder is clamped onto the frame by moving the crossbar 50A toward the apex portion and then securing it by the bolts associated with the slotted holes 51 and 52.

A simple scaffolding can be constructed comprising two ladders, having open ended tubular rungs, two A-frame brackets provided in accordance with the present invention and a plank or staging member of sufficient length to extend from one ladder to the other and project therebeyond. As seen from the foregoing each A-frame may be a single flat bar bent into a V (the apex flattened as previously described) with the legs interconnected by a crossbar providing an open window through which the ladder can project. The free outer ends of the legs may have brackets attached thereto as illustrated in FIG. 3 or bent outwardly as illustrated in FIG. 5. Alternatively the A-frame may be made of two identical components providing the crossbar and two identical components providing respective ones of the legs. The ladder may be restrained relative to frame by the stub shafts 70 shown in FIG. 5 or the threaded bolt 60 shown in FIG. 3. The frame 30 may be aluminum, plastic, steel or combinations thereof.

The ladder 11 has a pair of stiles 11A interconnected by a series of spaced apart tubular rungs 11B. The tubular rungs are open at each of opposite ends thereof and thus the bolt 60 is readily inserted therethrough.

Figure 6:
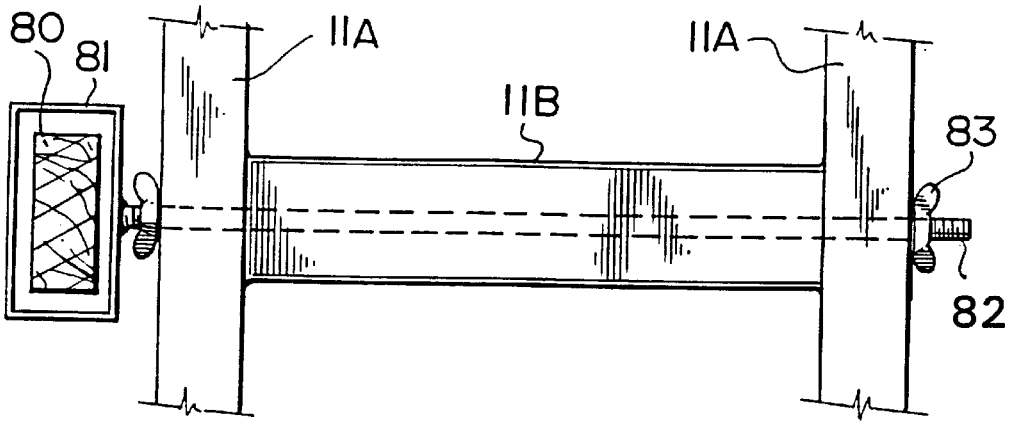
FIG. 6 is a partial elevational view of a bracket attached to the ladder and supporting a safety rail.

In FIG. 6 there is illustrated a portion of one of the ladders at an elevation above the plank 12. Referring to FIG. 6 a safety rail, for example a 2"×4" piece of wood, designated 80 is shown in end view. The rail 80 is anchored adjacent one end thereof to one ladder and adjacent the other end thereof to the other ladder. Each ladder has a threaded rod 82 that passes through a ladder rung 11B and it is anchored to the ladder by one or more wing nuts 83. A rectangular closed loop 81 is fixed as by welding to one end of the threaded rod 82. The member 80 slips through the closed loops and in position provides a safety rail. A pair of wing nuts as shown permits adjustably positioning the safety rail 80 relative to the pair of ladders i.e. move it closer to or further away from the wall 20.

Figure 7:
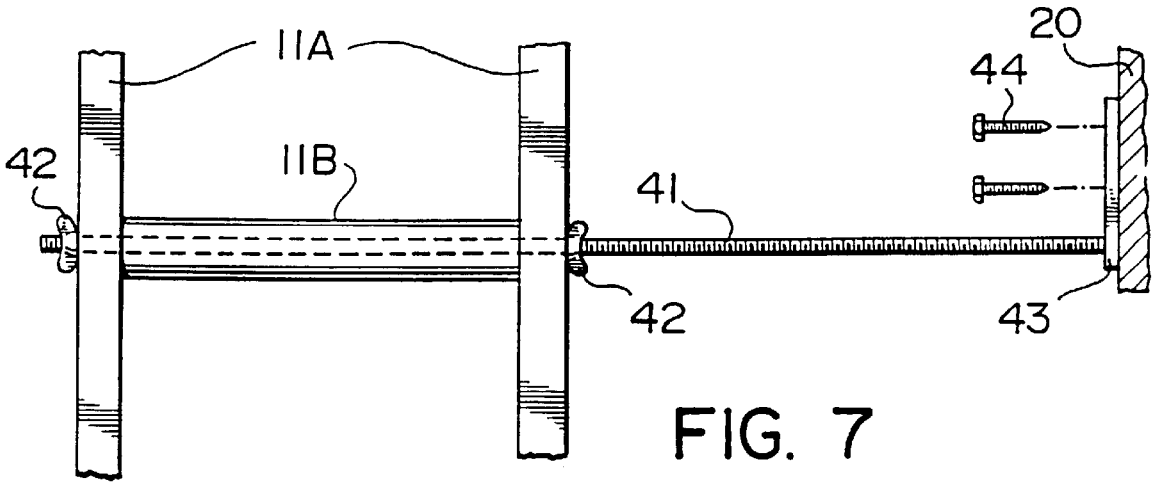
FIG. 7 is an elevational view of a portion of the ladder and a ladder stabilizing bracket.

The ladder stabilizing bracket 40 previously mentioned is shown in larger scale in FIG. 7. Bracket 40 comprises a threaded rod 41 that passes through one ladder rung 11B and is anchored to the ladder by a pair of wing nuts 42. An apertured plate 43 is fixed to an end of the rod 41 and threaded fasteners 44 anchor such plate to the wall 11.

Staging utilizing brackets of the present invention is safe, rigid and secure because the ladder effectively bisects the "V" defined by the legs 31 and 32 and because the ladder is tightly clamped between the apex portion of the frame and the crossbar 50 (or 50A as the case may be). Each bracket resists forces that are parallel to the wall in each of opposite directions. Each ladder is thus very stable as is the entire scaffold or staging structure.

We claim:

1. A ladder support bracket for use with a ladder having tubular rungs, said bracket comprising stiff members providing a rigid open A-frame that has an apex, a pair of legs extending from said apex and diverging in a direction away from said apex with each leg terminating at a free outer end, a crossbar secured to respective ones of said diverging legs interconnecting said legs at a position between said apex and said free outer ends and means for detachably anchoring said ladder to said frame and captively retaining such ladder between said apex of said frame and said crossbar when said ladder is located at a position between said diverging pair of legs, said ladder anchoring means being securable respectively to said crossbar and the apex of the frame and projecting from each to extend into a tubular rung of said ladder.

2. A ladder support bracket as defined in claim 1 including means detachably securing said crossbar to a respective one of said legs.

3. A ladder support bracket as defined in claim 2 wherein said crossbar is positionable and securable by said means at various different selected spacings from said apex.

4. A ladder support bracket as defined in claim 1 wherein said legs are provided by a pair of members and means detachably interconnecting said members at the apex of said A-frame.

5. A ladder support bracket as defined in claim 1 wherein said crossbar is adjustably variable in length.

6. A ladder support bracket as defined in claim 1 wherein said apex of said frame has a flat portion the length of which corresponds to the width of a stile of the ladder used therewith.

7. A ladder support bracket as defined in claim 6 wherein said legs of the frame are provided by a pair of members, wherein said pair of members overlap one another at said apex of the frame and means detachably joining together said overlapping portions.

8. A ladder support bracket for use with a ladder having tubular rungs, said bracket comprising stiff members providing a rigid open A-frame that has an apex, a pair of legs diverging in a direction away from said apex with each leg terminating at a free outer end, a crossbar interconnecting said legs at a position between said apex and said free outer ends and means for detachably anchoring said ladder to said frame and clampingly holding such ladder captive between said apex of the frame and said crossbar when said ladder is located at a position between said diverging pair of leas and wherein said means for anchoring the ladder to the frame comprises a bolt passing through aligned apertures respectively through said apex of the frame and said crossbar and means on said bolt to clampingly retain the ladder between said apex and said crossbar.

9. A ladder support bracket for use with a ladder having tubular rungs, said bracket comprising stiff members providing a rigid open A-frame that has an apex, a pair of legs diverging in a direction away from said apex with each leg terminating at a free outer end, a crossbar interconnecting said legs at a position between said apex and said free outer ends and means for detachably anchoring said ladder to said frame and clampingly holding such ladder captive between said apex of the frame and said crossbar when said ladder is located at a position between said diverging pair of legs and wherein said means for anchoring the ladder to the frame comprises a pair of units each having a stub shaft, a threaded bolt portion projecting from the shaft and a nut on said threaded bolt portion, one of said units having the threaded bolt portion passing through an aperture through the apex of the frame and the threaded bolt portion of the other unit passing through an aperture through said crossbar and wherein said stub shafts project toward one another and thereby are adapted to project into respective opposite open ends of a rung on the ladder.

10. A ladder support bracket for use with a ladder having tubular rungs, said bracket comprising stiff members providing a rigid open A-frame that has an apex, a pair of legs diverging in a direction away from said apex with each leg terminating at a free outer end, a crossbar interconnecting said legs at a position between said apex and said free outer ends and means for detachably anchoring said ladder to said frame and clampingly holding such ladder captive between said apex of the frame and said crossbar when said ladder is located at a position between said diverging pair of legs, wherein said apex of said frame has a flat portion the length of which corresponds to the width of a stile of the ladder used therewith, wherein said legs of the frame are provided by a pair of members, wherein said pair of members overlap one another at said apex of the frame and means detachably joining together said overlapping portions and including slotted apertures in at least one of said overlapping portions which permits adjustably varying the length of said flat apex portion of the frame.

11. Staging apparatus comprising:

(a) a pair of ladders each having hollow rungs;

(b) a ladder support bracket for each of said ladders to support the respective ladders in a vertical position spaced from a wall, said ladders being spaced apart from one another in a direction parallel to said wall, each said ladder bracket comprising an open rigid A-frame that has an apex, a pair of legs diverging in a direction away from said apex and terminating in outer ends detachably connected to said wall, and a crossbar interconnecting said legs at a position intermediate the length of such legs;

(c) means clampingly attaching the ladder to the support bracket associated therewith with the ladder being located between the apex portion of the frame and the crossbar, said means including a rod projecting into a hollow rung of the ladder; and (d) a staging element supported by a rung on the respective spaced apart ladders.

* * * * *